US005971187A

United States Patent [19]

Clee et al.

[11] Patent Number: 5,971,187

[45] Date of Patent: Oct. 26, 1999

[54] HINGE FOR A COLLAPSIBLE CONTAINER

[76] Inventors: Michael Clee, 65 Courtland Ave., Concord, Ontario, Canada, L4K 3T1; James Tramontin, 117 Cabana Dr., Weston Ontario, Canada, M9L 1L1

[21] Appl. No.: 08/768,159

[22] Filed: Dec. 13, 1996

Related U.S. Application Data

[60] Provisional application No. 60/008,727, Dec. 15, 1995.

[51] Int. Cl.[6] ..... B65D 6/22; E05D 3/02; E05D 5/02

[52] U.S. Cl. ..... 220/4.29; 220/4.34; 220/691; 220/692; 16/252; 16/382

[58] Field of Search ..... 220/4.29, 4.28, 220/4.31, 4.33, 685, 691, 693, 4.34, 692; 16/382–384, 259, 270, 388, 252, 254, 257, 234

[56] References Cited

U.S. PATENT DOCUMENTS

| | | | |
|---|---|---|---|
| 2,997,198 | 8/1961 | Hooker | 220/691 X |
| 3,234,996 | 2/1966 | King et al. | 16/382 |
| 3,781,944 | 1/1974 | Gianardi | 16/259 |
| 4,098,424 | 7/1978 | Liebscher et al. | 220/4.29 |
| 4,512,094 | 4/1985 | Seely | 40/156 |
| 4,670,938 | 6/1987 | Fowlston | 16/382 |
| 4,729,149 | 3/1988 | Brunkan . | |
| 4,828,132 | 5/1989 | Francis, Jr. et al. | 220/4.31 |
| 5,150,501 | 9/1992 | Pasternak . | |
| 5,520,477 | 5/1996 | Fink . | |

FOREIGN PATENT DOCUMENTS

| | | |
|---|---|---|
| 1008220 | 4/1977 | Canada . |
| 1045327 | 1/1979 | Canada . |
| 1061847 | 9/1979 | Canada . |
| 1071684 | 2/1980 | Canada . |
| 1189675 | 7/1985 | Canada . |
| WO 95 21774 | 8/1995 | WIPO . |

*Primary Examiner*—Stephen P. Garbe
*Assistant Examiner*—Niki M. Eloshway

[57] ABSTRACT

A hinge pivotally connects two side wall panels for use as a collapsible container. The hinge has a first leaf hingedly joined to a second leaf. The first leaf and second leaf each have a pair of spaced prehensile panels for receiving an edge of a side wall panel. The prehensile panels have a plurality of inwardly extending tabs. An internal clip is sized to extend through an aperture along the edge of each of the side wall panels. The internal clip engages the tabs interconnecting the spaced prehensile panels and attaches the first leaf and the second leaf to an edge of each of the two side wall panels.

2 Claims, 4 Drawing Sheets

HINGE FOR A COLLAPSIBLE CONTAINER

This application claims the benefit of provisional application Ser. No. 60/008727 filed Dec. 13, 1995.

1. Field of Invention

This invention relates to a hinge for connecting rigid panels. In particular, this invention relates to a hinge for a collapsible container.

2. Background of the Invention

Returnable/reusable containers for the transportation of goods is widely used. Such containers, or tote boxes, must have sufficient strength to be able to safely transport the goods stored therein without damage.

In certain applications, the containers have removable side wall panels which can be folded to reduce the volume of the returned carton. The side wall panels are hingedly connected together which allows for the side wall panels to collapse for stacking in the collapsed condition.

The side wall panels have molded plastic hinges which are riveted onto the corrugated plastic panels. Plastic or metal rivets are used which must be fully aligned with holes in the panels and hinges. The time required to position the hinges for drilling the holes and actually drilling the holes limits the speed at which such containers may be produced. If the holes are not aligned, the rivets do not sit flush on the surface presenting an unsightly appearance of a finished product. Further, the rivets are susceptible to being damaged during use, particularly if the rivets are not flush with the surface of the side wall panel.

SUMMARY OF THE INVENTION

The disadvantages of the prior art may be overcome by providing a hinge for pivotally connecting side wall panels which is internally connectable thereto.

It is desirable to provide a hinge which may be assembled and connected to side wall panels in a reduced time period.

It is desirable to provide a hinge which does not have exposed rivet heads for improving the lifespan of an assembly so constructed.

It is desirable to provide a hinge which connects to a side wall panel using an internal fastener presenting a clean appearance minimizing the risk of damage to the fastener during use.

It is desirable to provide a hinge which can be easily repaired and replaced.

According to one aspect of the invention, there is provided a hinge for pivotally connecting two side wall panels. Each of the panels has apertures spaced along opposite end edges thereof. The hinge comprises a first leaf hingedly joined to a second leaf. The first leaf and second leaf each have a pair of spaced panels for receiving an edge of one of the side wall panels therebetween. An internal fastener is extendable through the aperture and releasably connected between opposite internal faces of the spaced panels for attaching each of the first leaf and the second leaf to the edge of the two side wall panels.

According to one aspect of the invention, there is provided a hinge for pivotally connecting two panels. Each panel has an aperture spaced along opposite edges thereof. The hinge has a first leaf hingedly joined to a second leaf. The first leaf and second leaf each has a pair of spaced clips for receiving an edge of one of the panels. An internal fastener extends through the aperture and engages opposite internal faces of the clips for attaching each leaf to the edge of the panel.

According to one aspect of the invention, there is provided a hinge which pivotally connects two side wall panels for use as a collapsible container. The hinge has a first leaf hingedly jointed to a second leaf. The first leaf and second leaf each has a pair of spaced prehensile panels for receiving an edge of a panel in a sandwich-like condition. The panels each has a plurality of inwardly extending tabs. An H-shaped clip is sized to extend through an aperture along the edge of each of the side wall panels. The H-shaped clip engages the tabs interconnecting the spaced prehensile panels and internally attaches the first leaf and the second leaf to an edge of adjacent side wall panels.

According to another aspect of the invention, there is provided a method of assembling a collapsible container. The method comprises the steps of:

inserting an internal fastener through an aperture along an end edge of a side wall panel, slidably inserting the side wall panel between a pair of spaced panels of a hinge leaf and slidably engaging the internal fastener with means for receiving the internal fastener on the opposite internal faces joining the spaced panels together and engaging the side wall panel.

According to another aspect of the invention, there is provided a collapsible container comprising four side wall panels and four hinges hingedly joining the side wall panels together. Each of the hinges has a first leaf hingedly joined to a second leaf. The first leaf and the second leaf each have a pair of spaced panels for receiving an edge of one of the side wall panels therebetween. An internal fastener is extendable through an aperture along an end edge of the side wall panels and releasably connected between opposite internal faces of the panels together for attaching each of the first leaf and the second leaf to the side wall panels.

DETAILED DESCRIPTION OF THE DRAWINGS

In drawings which illustrate embodiments of the invention,

DETAILED DESCRIPTION OF THE INVENTION

Figure 1:
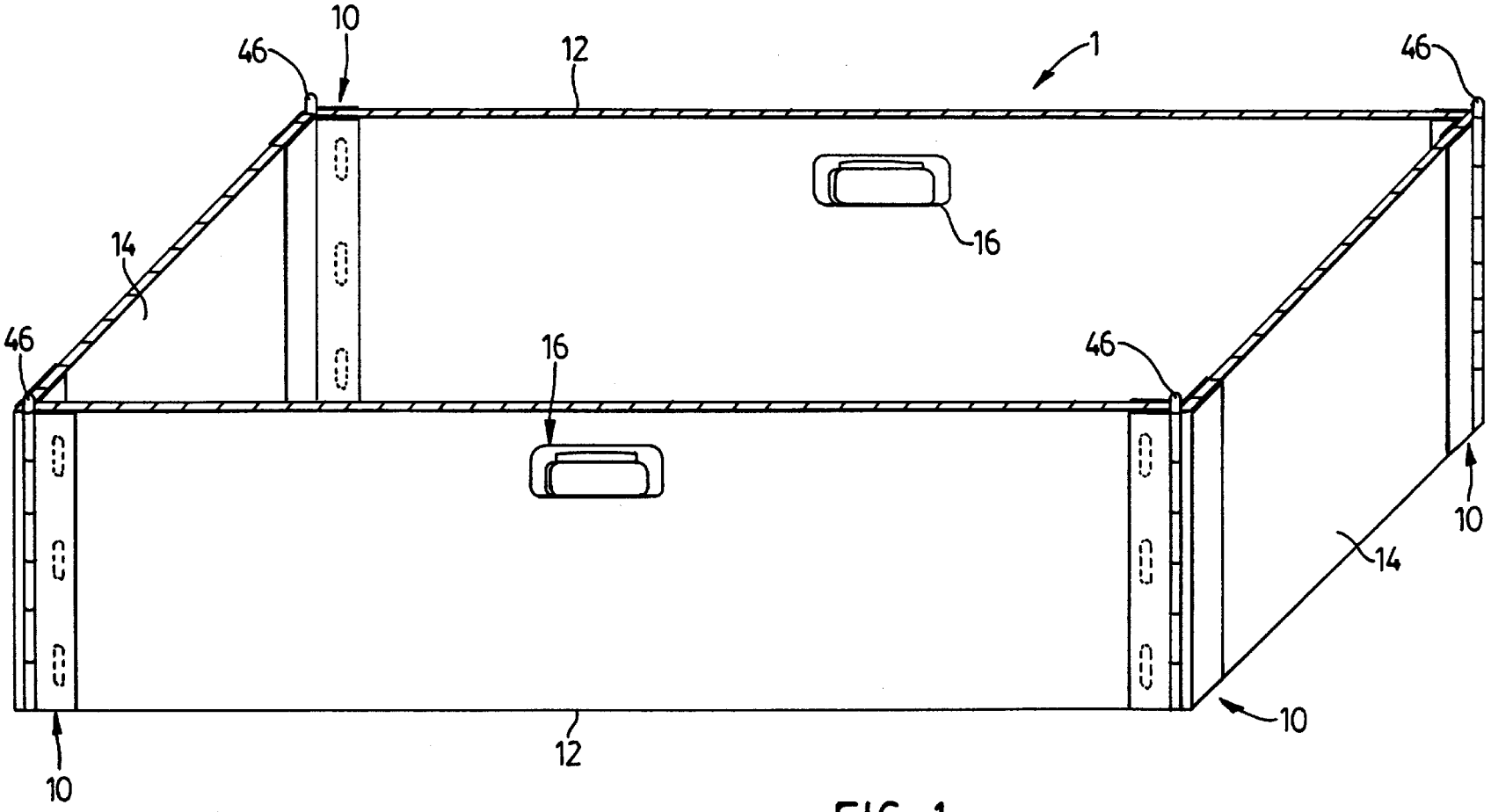
FIG. 1 is a perspective view of the container incorporating the hinge of the present invention.
Figure 2:
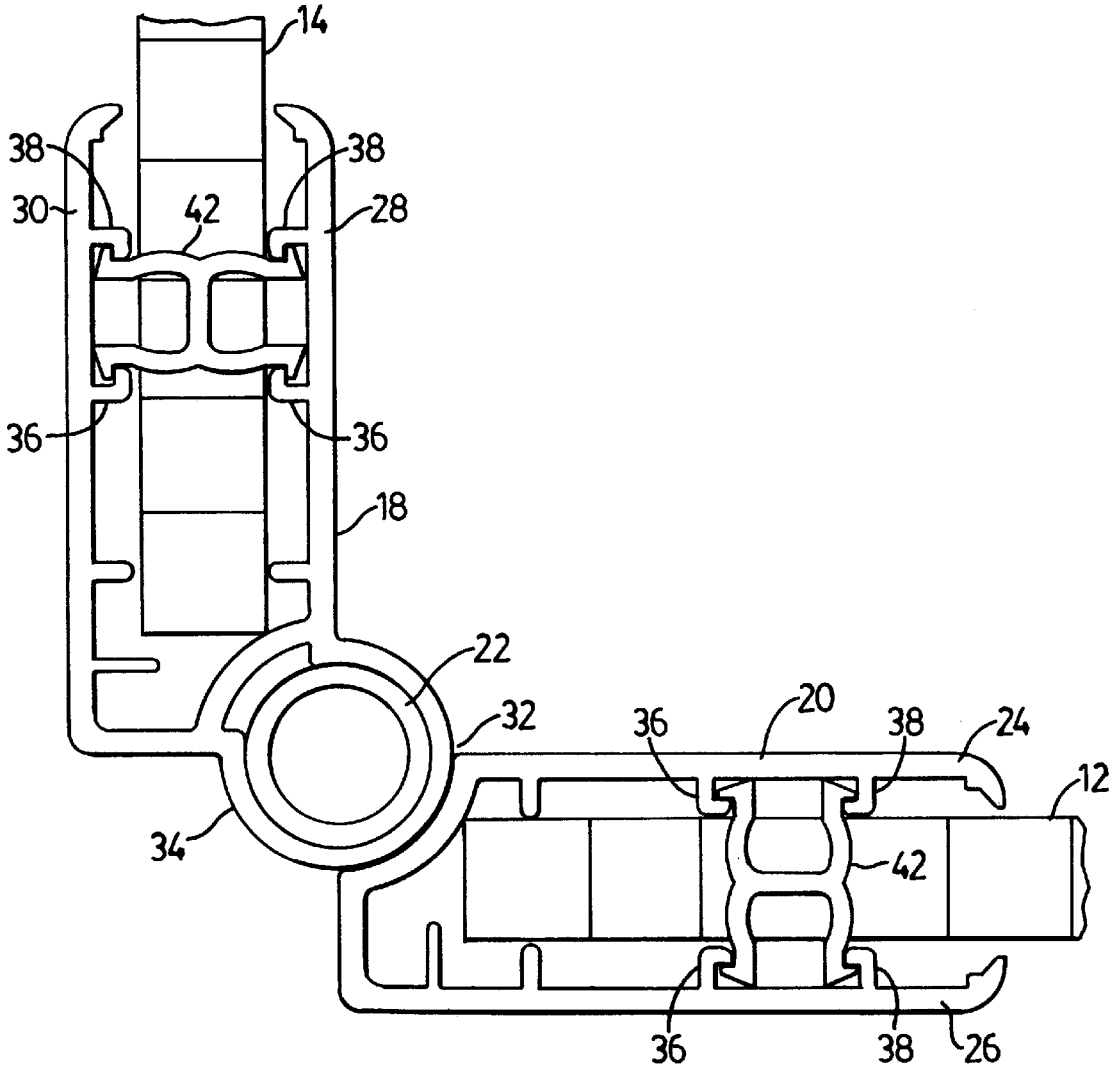
FIG. 2 is an end view of the hinge of FIG. 1.
Figure 3:
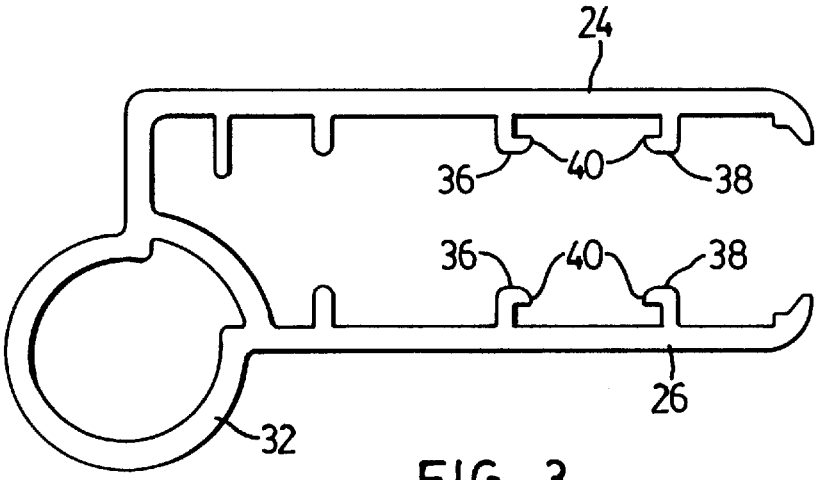
FIG. 3 is an end view of the extrusion for a prehensile panel of the invention of FIG. 2.

Referring to FIG. 1, the collapsible container 1 incorporating the hinges 10 of the present invention is illustrated. The collapsible container 1 generally has four side wall panels 12 and 14 with four hinges 10 interconnecting the side wall panels 12 and 14.

Side wall panels 12 are provided with handles 16 for manipulating the collapsible container 1. Preferably, side wall panels 12, 14 are made of corrugated plastic. However, it will be readily understood that other rigid panel materials, including cardboard, may also be used with the present invention.

Referring to FIGS. 2 to 6, the hinge 10 and components thereof are more particularly illustrated. Hinge 10 comprises a leaf 18 and 20 which are pivotally connected together by an extruded core 22. Each leaf 18 and 20 is complementary to each other to interengage in a pivoting manner.

Each leaf has two spaced apart prehensile panels or sleeves 24, 26 and 28, 30 which cantilever from a circular core section 32 and 34, respectively. On inside opposite faces of each prehensile panel are inwardly extending tabs 36 and 38, defining an open channel. Tabs 36 and 38 each has a flange 40 which are directed towards each other. Flange 40 presents a detent.

An internal fastener for joining the side wall panel 12 to the hinge 10 comprises an extruded H-shaped clip 42 which has a flange 44, presenting a complementary detent at the distal end of on each arm of the H-shape. Flanges 44 extend outwardly to cooperate and interlock with flanges 40 on tabs 36 and 38. Clip 42 is sized to fully register within tabs 36 and 38 in a sliding or interference fit. Preferably, the height of clip 42 is slightly less than the space between clips 24, 26 and 28, 30 in order to used the natural bias of the material to maintain engagement of clips 42 with tabs 36 and 38.

Other shapes of clips are also contemplated within this invention, including arrow shaped clips.

Figure 4:
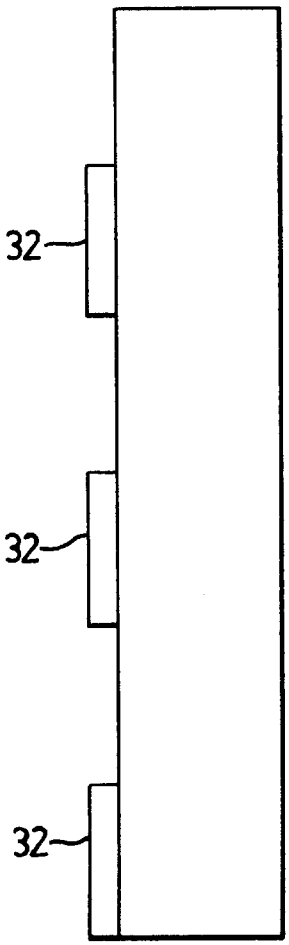
FIG. 4 is a side elevation view of the prehensile panel of FIG. 3.
Figure 5:
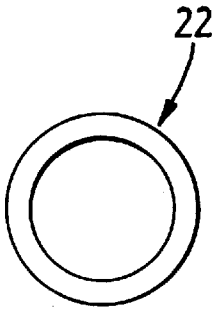
FIG. 5 is an end view of the core of the hinge of FIG. 2.
Figure 6:
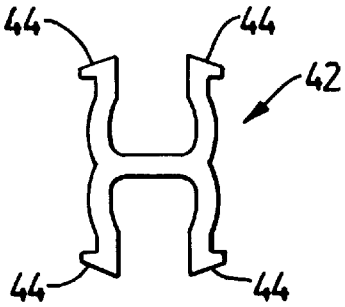
FIG. 6 is an end view of an H-shaped clip of the hinge of FIG. 2.

Preferably, the components of hinge 10 are made from an extruded PVC material. As illustrated in FIG. 4, the hinge components can be extruded as a continuous piece and then cut to size from a common extrusion. The circular core section 32 and 34 is offset from pair of spaced panels 24, 26 and 28 and 30. The circular core section 32 and 34 can be cut out in an alternating pattern to complementarily fit together. As is apparent, a single or common extrusion can be used for both of the leaves 18 and 20, with the circular core section being cut out in an alternating pattern and then inverted. Once the circular cores sections 32 and 34 are aligned, the core 22 is inserted to hingedly or pivotally connect the leaf 18 to leaf 20. A cap 46 covers the end of the core 22. Optionally, the cap 46 may be integral with the core 22.

Figure 7:
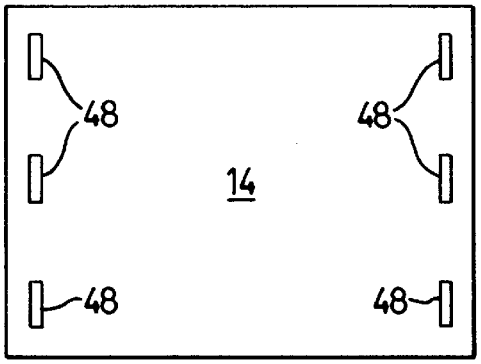
FIG. 7 is a side elevational view of a side wall panel of the container of FIG. 1.
Figure 8:
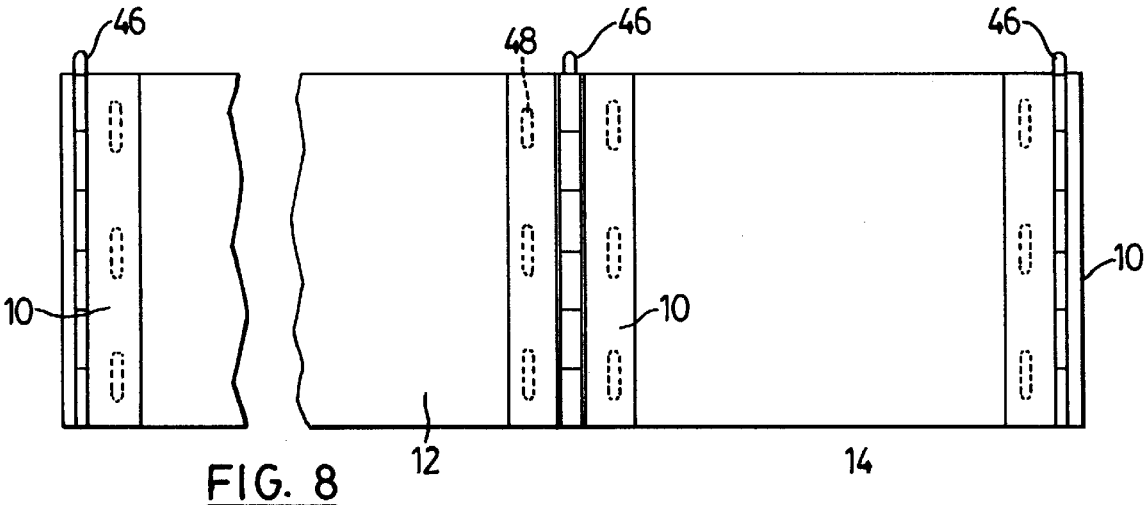
FIG. 8 is a side elevational view of the container of FIG. 1 in a collapsed condition.

Referring to FIG. 7, the side wall panel 14 is illustrated. The side wall panel has a series of holes 48 cut along opposite edges thereof. The spacing of the holes relative to the vertical edge of side wall panel 14 coincides with the positioning of the tabs 36 and 38 relative to the circular core section 32, 34.

Figure 9:
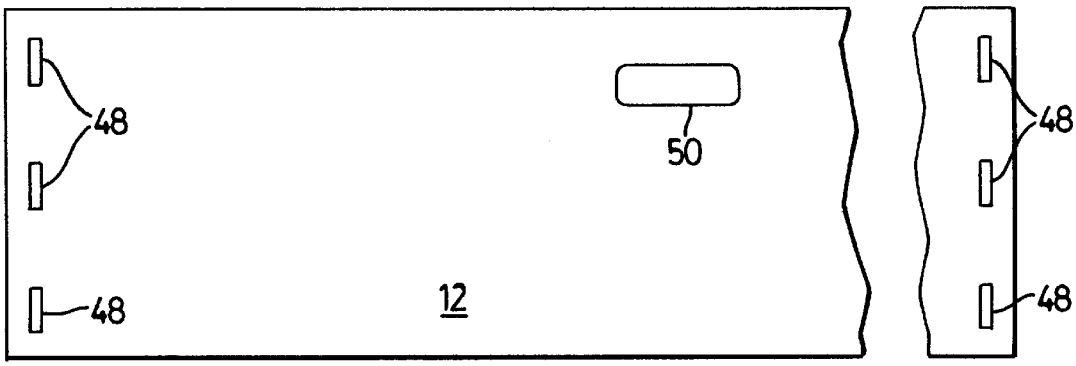
FIG. 9 is a side elevational view of a side wall panel of the container of FIG. 1.

Referring to FIG. 9, the side wall panel 12 is illustrated. The side wall panel has a series of holes 48 cut along opposite edges thereof. Similarly, the spacing of the holes relative to the vertical edge of side wall panel 12 coincides with the positioning of the tabs 36 and 38 relative to the circular core section 32, 34. The side wall panel has an aperture 50 which is sized to fit handles 16.

To assemble a container 1, clips 42 are placed in holes 48 such that tabs 44 extend out of the face of the side wall panels 12, 14. Each leaf 18 and 20 is slid along the edge of the side wall panels 12 and 14 such that tabs 36 and 38 will align and complementarily fit with tabs 44 of clips 42 and interconnect each of opposite prehensile panels 24, 26 and 28, 30. Depending on the relative sizes of the clips 42 and the distance between each opposite prehensile panels 24, 26 and 28, 30, some compression of the prehensile panels 24, 26 and 28, 30 may be required.

Once each leaf 18 and 20 is mounted on each end of the side wall panel 12 and 14, complementary edges of presented together and the circular cores 32 and 34 are aligned. Core 22 is then threaded through the circular cores 32 and 34 to retain the side wall panels 12 and 14 in a hinged relation. Cap 46 is then inserted to close the end of the circular core 32, 34.

Once assembled, the collapsible container 1 may be used together with a pallet in a manner well known in the art.

It is also understood that not all containers are collapsible. A solid extrusion could be used which uses the extruded fastener as described herein.

Although the disclosure describes and illustrates the preferred embodiments of the invention, it is understood that the invention is not limited to these particular embodiments. Many variations and modifications will now occur to those skilled in the art. For definition of the invention, reference is made to the appended claims.

We claim:

1. A hinge for pivotally connecting two side wall panels, each of said panels having apertures spaced along opposite edges thereof, said hinge comprising:

a first H-shaped internal fastener extendable through a first aperture in a first side wall panel;

a second H-shaped internal fastener extendable through a second aperture in a second side wall panel;

a first leaf having a first sleeve for receiving an edge of said first side wall panel;

a second leaf hingedly joined to said first leaf, said second leaf having a second sleeve for receiving an edge of said second side wall panel;

said first and second sleeves each having opposing internal surfaces forming an open channel complementary to, and for engaging, said respective first and second internal fasteners to releasably secure said side wall panels to each said first and second leaf, each said open channel having a plurality of inwardly extending tabs, said tabs having flanges at their distal ends for retaining distal ends of arms of said internal fasteners to interlock said internal fasteners within said open channels in a sliding fit.

2. A collapsible container comprising four side wall panels and four hinges hingedly joining said side wall panels together, each of said hinges comprising:

a first internal fastener extendable through a first aperture in a first side wall panel;

a second internal fastener extendable through a second aperture in a second side wall panel;

a first leaf having a first sleeve for receiving an edge of said first side wall panel;

a second leaf hingedly joined to said first leaf, said second leaf having a second sleeve for receiving an edge of said second side wall panel;

said first and second sleeves each having opposing internal surfaces forming an open channel complementary to, and for engaging, said respective first and second internal fasteners to releasably secure said side wall panels to each said first and second leaf, each said open channel having a plurality of inwardly extending tabs, said tabs having flanges at their distal ends for retaining distal ends of arms of said internal fasteners to interlock said internal fasteners within said open channels in a sliding fit.

* * * * *